US005469903A

United States Patent [19]

Stanley

[11] Patent Number: 5,469,903

[45] Date of Patent: Nov. 28, 1995

[54] METHOD OF MAKING SIMULATED SOLID WOOD SLABS AND RESULTING SOLID WOOD SLAB

[76] Inventor: Kenneth Stanley, 138 Monmouth Rd., Spotswood, N.J. 08884

[21] Appl. No.: 320,173

[22] Filed: Oct. 7, 1994

Related U.S. Application Data

[63] Continuation of Ser. No. 52,149, Apr. 23, 1993, Pat. No. 5,355,654.

[51] Int. Cl.[6] ..... B27F 7/00; B27D 1/00; E06B 3/70

[52] U.S. Cl. ..... 144/345; 52/455; 52/456; 52/802.11; 144/346; 144/355

[58] Field of Search ..... 52/455, 456, 785, 52/789, 809; 144/344, 345, 346, 355; 49/501

[56] References Cited

U.S. PATENT DOCUMENTS 579,696 3/1897 Carter ..... 52/455
632,700 9/1899 Cronin ..... 52/456
3,546,841 12/1970 Smith .
4,513,553 4/1985 Barry ..... 52/456

*Primary Examiner*—W. Donald Bray
*Attorney, Agent, or Firm*—Jeffrey I. Kaplan

[57] ABSTRACT

A method of simulating a solid wood multipanel door is disclosed. Predetermined portions of the thin sheets of wood which are typically used to construct hollow core doors are cut away. The portions are used to construct artificial door panels, which are replaced into the openings in the hollow core door from which they were cut. Molding is then placed around the artificial door panels. In an alternative embodiment, Wainscott panels may be constructed utilizing the inventive technique.

4 Claims, 3 Drawing Sheets

METHOD OF MAKING SIMULATED SOLID WOOD SLABS AND RESULTING SOLID WOOD SLAB

This application is a Rule 1.60 continuation of application Ser. No. 08/052,149, now U.S. Pat. No. 5,355,64.

This patent application corresponds to Disclosure Document No. 07531, filed Apr. 30, 1992. Such disclosure document is not to be taken as an admission of the earliest date of invention to which applicant is entitled.

TECHNICAL FIELD

This invention relates to a technique for the manufacture of wood slabs, and more specifically, to a method of producing simulated solid wood slabs from hollow core panels, as well as the resulting simulated solid wood slabs. The invention is most advantageously utilized in connection with the manufacture of simulated solid wood doors from hollow core doors.

BACKGROUND OF THE INVENTION

Solid wood doors have been utilized for centuries. The preferred type of solid wood door does not utilize a simple flat piece of wood. Rather, the doors are manufactured as "n" panel doors, with a typical value of n being four or six.

FIG. 1 shows a typical prior art solid wood four panel door 101. The door is manufactured from numerous vertical styles 103*a*–103*c* and horizontal rails 102*a*–102*c*. During manufacture, rails 102*a*–102*c* are first joined to style 103*a*. Next, the two left hand panels 104 are placed appropriately, and the center rail 102*c* is connected to the arrangement, thereby holding the panels in place. Next, the two rightmost panels are installed, after which the rightmost rail 103*c* is joined, thus completing the solid wood door.

The door can have any different number of panels, and can be made of oak, pine, cherry, or any of a large number of other woods. The wood and the multipanel three dimensional design on the door are both aesthetically pleasing and quite luxurious. Thus, solid wood doors are normally the preferred type.

These doors contain at least three drawbacks. First, the wood is quite costly, thereby making the door expensive for the consumer. Additionally, the door is heavy since it is made entirely of solid wood. It is therefore relatively cumbersome and difficult to install. Finally, the solid wood out of which the door is made is subject to expansion and contraction due to changes in humidity and weather.

"Hollow core" doors have come into widespread use over the past several decades, partially because they are far less costly than solid wood doors. A hollow core door is constructed by first building a rectangular frame from four wood slats of equal width. The rectangle defined by the frame is made to be the size of the desired door. Next, a thin sheet of wood is bonded to each side of the wood frame. Cardboard is often wedged between the sheets of wood, in order to provide additional support and to maintain the spacing between the thin sheets of wood constant.

The problem with hollow core doors is that they are easily recognized as an inexpensive substitute for a real wood door. Hollow core doors are less aesthetically pleasing and luxurious looking, and people desiring an elite looking product are not happy with the doors. Thus, these customers are forced to spend large amounts of money on solid wood doors.

In view of the above, it can be appreciated that there exists a need for an affordable, easy to manufacture multipanel door which is easy to install and which gives the same aesthetically pleasing appearance as a solid wood door.

SUMMARY OF THE INVENTION

The above and other problems of the prior art are overcome and a technical advance is achieved in accordance with the present invention which relates to an improved method for the manufacture of simulated multipanel slabs and the resulting slab. In the preferred embodiment, the slab is a door.

In accordance with the invention, two thin rectangular sheets of wood are bonded to a rectangular frame to form a hollow core door. Outlines of the desired "panels" (i.e., as on a solid wood multipanel door) are drawn on one of the sheets, and the outlined portions are then cut away from both sheets of wood, leaving openings through the hollow core door at the locations and of the size of the desired panels.

Next, the Space separating the thin sheets of wood on the removed portions is altered (e.g. reduced) to form an artificial panel. Such alteration may be accomplished by removing the cardboard between the sheets and replacing it with a thinner material. The sheets of wood on the removed portions ("sheet portions") may optionally be mounted on plywood to form the artificial panel. The artificial panels are then replaced into the openings out of which they were cut.

The artificial panels are placed within the openings equidistant from both the front and rear of sheets of wood. Molding is then placed around the artificial panels and pins, staples, or other connecting means are inserted through the molding and artificial panels to hold them in place. The artificial panels give the appearance of a solid wood door at a fraction of the cost.

Since the space separating the sheets of wood on the removed portions has been altered, the front and rear surfaces of the artificial panels are not in the same plane as the front and rear surfaces of the remainder of the hollow core door. Because of this multiple plane design, the entire door appears as a solid wood, multipanel door with a three dimensional design thereon.

The resulting door is a hollow core door with predetermined portions (the artificial panels) of each side that are outside the plane of the remainder of that side of the door. By placing predetermined portions of each side of the door in a different plane from the remainder of that side and by surrounding the predetermined portions with molding, the door takes on the appearance of a multipanel solid wood door. Since the door is not actually made from solid wood, it can be sold at a significantly less cost and is substantially lighter in weight.

DETAILED DESCRIPTION OF THE PREFERRED EMBODIMENT

Figure 1:
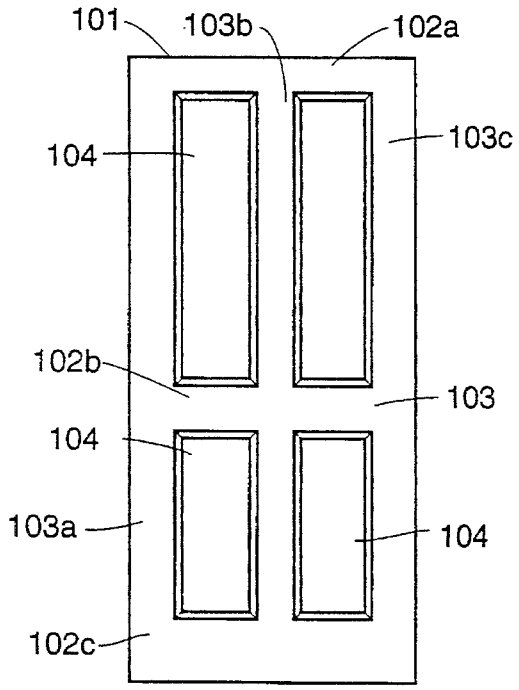
FIG. 1 Prior Art
FIG. 1 depicts a front view of a prior art four panel solid wood door.
Figure 2:
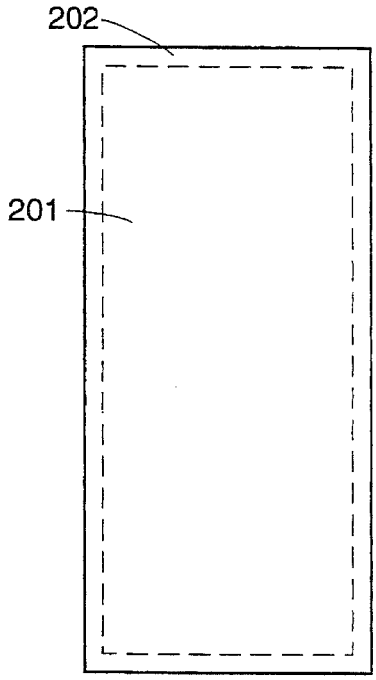
FIG. 2 shows a front view of a hollow core door, including the wood frame shown in dotted outline.

FIG. 2 shows the a front view of a standard hollow core door 201. Shown in dotted outline is a wood frame 202 onto which two thin sheets of wood are mounted to form the door. The frame is typically constructed from four wood slats of equal width.

Figure 3:
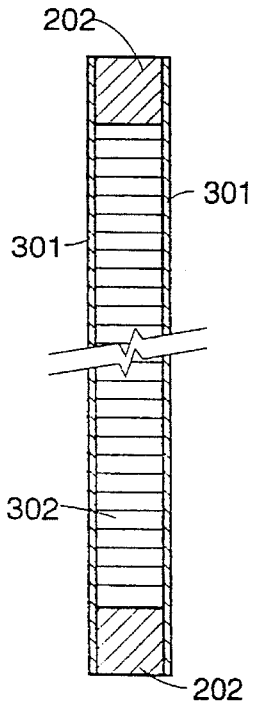
FIG. 3 is a side cutaway view of a hollow core door which may be used to practice the present invention.

A side cut away view of hollow core door 201 is shown in FIG. 3. The two thin sheets of wood 301 are bonded to a frame 202 with glue. Typically, cardboard 302 is placed between sheets of wood 301 in order to provide additional support and to assist in maintaining constant the spacing between the sheets of wood 301. The thin sheets of wood 301 are intended to encompass what is commonly termed "veneers" but may include other types of materials also.

Figure 4:
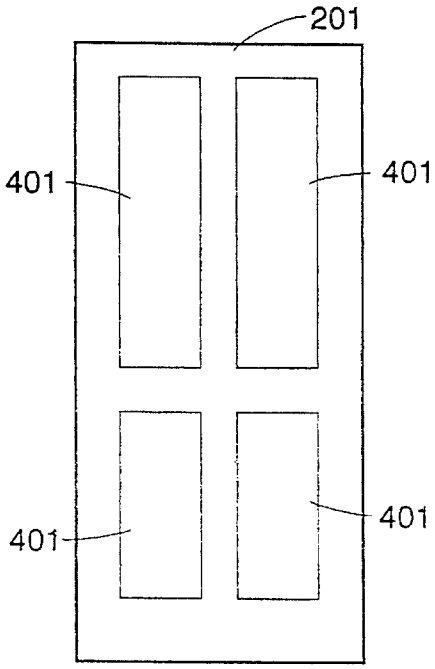
FIG. 4 shows a front view of a hollow core door with a stenciled pattern thereon, which stenciled pattern may be cut away in order to construct a simulated multipanel door in accordance with the teachings of the present invention.

FIG. 4 shows a front view of hollow core door 201 with four rectangles 401 drawn thereon. The rectangles are drawn at the locations and of the size of panels on, for example, a four panel solid wood door. The rectangles are easily placed on door 201 using a template and marker.

After the rectangles are drawn, a router or similar tool is utilized in order to cut out and remove all four portions 401 which are outlined in FIG. 4. The tool used to remove the portions should belong enough to penetrate through both the back and the front of door 201, so that a rectangular portion of both the front and rear sheets of wood 301 which form the door are cut away. Alternatively, the template can be placed on door 201 and the router utilized to follow the template, in accordance with known techniques. This alternative technique is believed to be simpler. No marker need be used.

Figure 5:
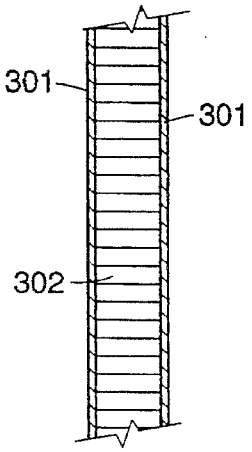
FIG. 5 depicts a side view of a portion removed from the hollow core door, which portion will be processed into an artificial panel and replaced to form the simulated multi-panel solid wood door.

A side view of one of the removed portions 401 is shown in FIG. 5. Each portion 401 includes cardboard 302 between the two sheets of wood. The four portions will serve as artificial panels to make the simulated solid wood door as described below. It is noted that since the portions 401 are replaced back into the openings from which they were removed, the grain of the wood at the borders of the artificial panels will look substantially continuous. This provides for an even more authentic appearance.

Figure 6:
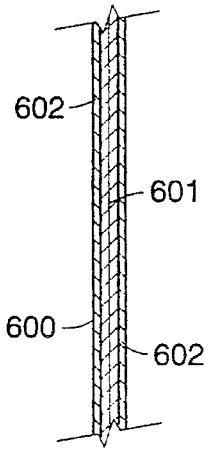
FIG. 6 shows an artificial panel to be installed into the hollow core door.

FIG. 6 shows a side view of one of said artificial panels 600 which may be utilized in accordance with the teachings of the present invention. The panel consists of two rectangular thin sheet portions 602 which were removed from door 201 by cutting an opening therethrough as previously described. After cardboard 302 is removed, each sheet portion 602 is mounted to a plywood plate 601. The sheet portions 602 are preferably mounted to the plywood plates 601 using wood glue, but other suitable techniques may also be employed. Additionally, while plywood is the preferred material, other materials may be utilized.

For purposes of explanation herein, a sheet portion is a thin sheet of wood that is smaller in area than the area of a side of the particular door. The sheet portion is preferably cut from the door, but may be obtained from a separate thin sheet of wood.

The process is repeated for all four artificial panels, each of which is constructed using the sheet portions removed from the door and indicated by rectangles 401 of FIG. 4. The artificial panels and the hollow core door should be marked to ensure that each artificial panel is replaced into the same opening out of which it was cut. As previously noted, this will keep the grain of the wood continuous on the completed door.

Figure 7:
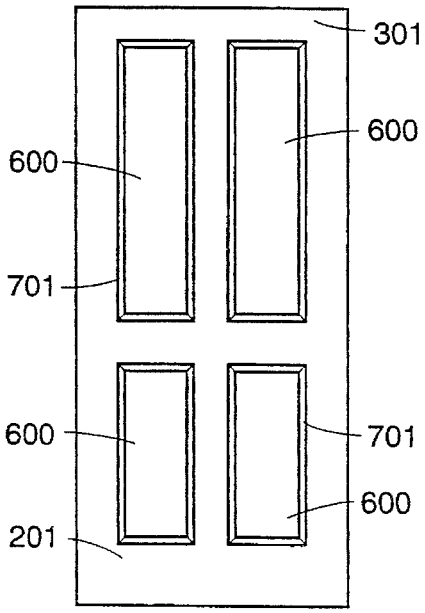
FIG. 7 is a front view of a completed door made in accordance with the teachings of the present invention.

FIG. 7 shows a completed door made in accordance with the present invention. The artificial panels 600 are replaced in the openings of the hollow core door 201 out of which the sheet portions 602 were cut. Molding 701 is custom cut to frame each artificial panel 600, thereby providing a more authentic look. Additionally, molding 701 serves to hold the artificial panels in place, as described below with reference to FIG. 8.

Figure 8:
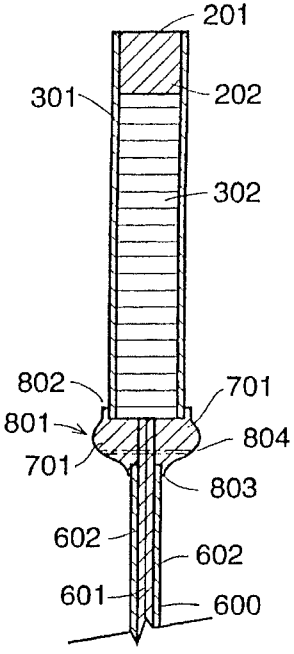
FIG. 8 is an enlarged representation of the installation of a single artificial panel into the hollow core door.

FIG. 8 is a side cross-sectional view of one of the artificial panels 600 as installed in the hollow core door 201. The particular artificial panel 600 shown in FIG. 8 is one of the artificial panels toward the top of door 201. Thus, the top portion of frame 202 is visible in FIG. 8.

The moldings 801 are installed on opposite sides of the artificial panel 600 as shown. It can be seen from FIG. 8 that the artificial panel 600 is centered between the front and rear of door 201. Thus, the sheet portion 602 toward the front of the door is out of the plane defined by the thin sheet of wood 301 which defines the remainder of the front of the hollow core door 201. Similarly, the sheet portion 602 towards the rear of the door is outside the plane defined by the sheet of wood 301 which defines the remainder of the rear of the door.

Each molding 701 includes a first lip 802 which is shaped to mate exactly with the hollow core door 201 surrounding the artificial panel as shown in FIG. 8. Each molding further includes a second lip 803 which is shaped to mate with the sheet portions 602 of artificial panel 600. The sheet portions 602 sit under the second lip 803, while the plywood 601 fits between the moldings 701 as shown.

The artificial panel 600 is preferably held in place with a plurality of pins that pass through the moldings 701 and plywood 601. Preferably, several pins are inserted on each side of the artificial panel 600 in order to hold each molding 701 to the plywood plate 601. Additionally, several longer pins are utilized which pass through both moldings and the plywood therebetween. These longer pins, one of which is indicated as 804, hold the artificial panels in place. Of course, glue, staples, or any other suitable technique may be utilized to hold each artificial panel 600 in place.

FIG. 7 shows that the finished door contains artificial panels 600 which are outside of the plane defined by sheet of wood 301. The rear of the door 201 would preferably appear identical to the front of the door as shown in FIG. 7. Of course, stain, varnish, or any other finishing coat may be applied to the surfaces of the finished door.

It is noted that the above embodiment utilizes two plywood plates 601. A single plywood plate may be utilized instead, and each of the sheet portions 601 bonded to an opposite side thereof. However, it has been found more advantageous to use two plywood plates as previously described.

While the above describes an exemplary embodiment, there are numerous other embodiments which may be employed, each of which simulates a much more expensive door. Each of these alternative embodiments is made from a hollow core door.

In one embodiment, the artificial panels may be raised panels, rather than the recessed panels described herein. In the raised panel embodiment, the spacing between the sheet portions 602 is increased rather than decreased, before the artificial panel is replaced into the opening in the hollow core door. The artificial raised panels can be made by replacing plywood 601 with one or more sheets of plywood that are thicker than the thickness of the remainder of the hollow core door. In this case, the artificial. panels would be raised out of the plane defined by thin sheets 301, rather than appearing depressed into the plane as shown in FIG. 8.

A still third embodiment of the present invention employs a single thin sheet of glass or plastic as the artificial panel. Such an artificial panel may optionally contain a stained glass design thereon. A cutaway and partially unassembled view of this embodiment is shown in FIG. 9.

Figure 9:
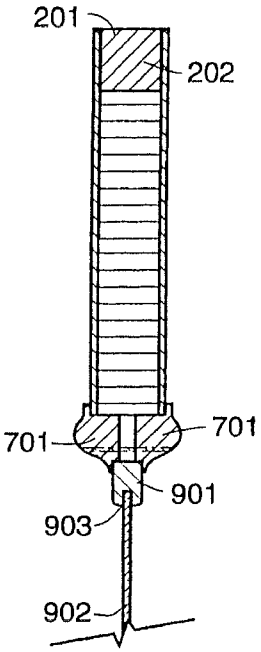
FIG. 9 depicts a portion of an alternative embodiment wherein a glass plate may be used instead of a wood artificial panel.

Glass plate 902, only partially shown in FIG. 9, is cut to the shape of a rectangle to match the size of the opening cut out of hollow core door 201. A clamp molding 901 is placed around the glass plate 902 as shown in FIG. 9. The clamp molding 901 includes a groove 903 into which the glass plate 902 fits. The groove 903 should ideally be wide enough so that glass plate 902 fits snugly but removably therein.

Figure 10:
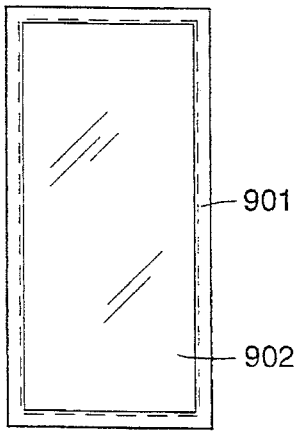
FIG. 10 shows a glass plate ready for installation into the embodiment of FIG. 9.

As FIG. 10 shows, the clamp molding entirely surrounds the border of glass plate 902. The clamp molding is then held in place by glue or pins in the same manner as described previously with respect to the artificial panel 600. In this embodiment, care should be taken to ensure that the nails, pins, etc., penetrate only clamp molding 901 and not glass plate 902.

Figure 11:
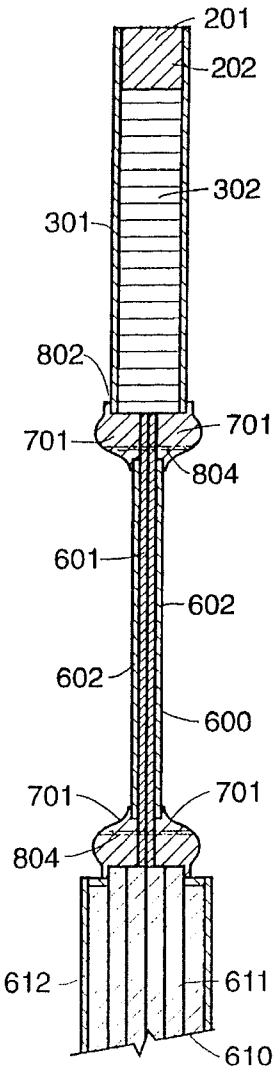
FIG. 11 shows a raised panel embodiment of the invention.

FIG. 11 shows a combination recessed panel and raised panel embodiment of the present invention. An artificial panel 610 is made from sheet portions 612 in a similar manner to that previously described. Artificial panel 610 however, is constructed from plywood plates 611, the combined thickness of which is greater than the thickness of the remainder of hollow core door 201.

Since the thickness of artificial panel 610 is greater than that of the remainder of hollow core door 201, artificial panel 610 simulates a raised panel. The artificial raised panel 610 can be installed into the opening out of which it was cut or, as shown in FIG. 11, can be surrounded completely by an artificial recessed panel 600.

Figure 12:
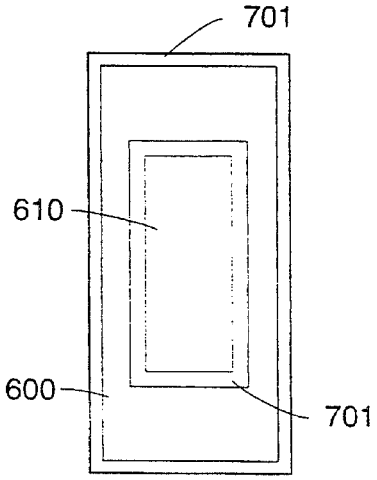
FIG. 12 shows a front view of the embodiment of FIG. 11.

FIG. 12 shows a front view of the panel of FIG. 11. The artificial panels 600 and 610 combine to appear as a raised panel surrounded by a recessed panel. A portion of the door 201 into which the artificial panels 600 and 610 are installed is also shown in FIG. 12.

Other materials and configurations may be utilized for the artificial panels. Additionally, while the invention has been described with respect to a four panel door, any number of panels and/or patterns may be used by simply cutting more openings through the hollow core door. Indeed, the invention is not even limited to doors, but may be utilized in any application where it is desired to simulate a solid wood slab, with a three dimensional design, without incurring the costs of using expensive solid wood.

In an additional embodiment, Wainscott panels may be manufactured using the inventive technique. Wainscott panels are typically employed to make walls with a three dimensional design. These panels are usually made of solid wood, but the present invention can simulate such panels without using solid wood panels. A first thin sheet of wood is disposed against the wall in one plane. The first thin sheet of wood includes numerous openings, which are filled with artificial panels in a different plane from the first thin sheet of wood, as in the case of the simulated solid wood door. The artificial panels are optionally surrounded with molding. The Wainscott panel utilizes only a one sided design, unlike the door which preferably utilizes the same design on opposite sides thereof.

Regarding the method of manufacture, the simulated solid wood doors need not be manufactured from a completed hollow core door. Rather, the sheets of wood 301 can be stacked and precut, leaving the openings therein. The precut sheets can then be glued to a wood frame, and the artificial panels mounted in a similar fashion as was previously described. In order to keep the grain of the wood continuous, all of the cut away portions and resulting openings would have to be matched up, so that the artificial panels are all placed into the openings out of which they were cut.

While the above describes the preferred embodiments of the invention, various modifications and or additions will be apparent to those of ordinary skill in the art. Such other embodiments which fall within the spirit and scope of the invention are intended to be covered by the following claims.

I claim:

1. In a hollow core door having a wood rectangular frame, a first thin sheet of wood on a first side thereof, and a second thin sheet of wood on a second side thereof, said first and second sheets being of the same shape and size as said frame, each of said thin sheets of wood having an inside and an outside, a method of simulating a solid wood door, said method comprising the steps of:

cutting at least one opening through both sheets of wood;

forming at least one artificial panel, said at least one artificial panel being of a different thickness than said hollow core door;

attaching each of said at least one artificial panels within each of said at least one openings by placing molding on the outside of the sheets of wood, and connecting the molding to the artificial panel so that the panel is .sandwiched between the molding from the first thin sheet of wood and the molding from the second thin sheet of wood.

2. The method of claim 1 wherein said artificial panel is thicker than said hollow core door.

3. The method of claim 1 wherein said artificial panel is thinner than said hollow core door.

4. In a hollow core door having a wood rectangular frame, a first thin sheet of wood on a first side thereof, and a second thin sheet of wood on a second side thereof, said first and second sheets being of the same shape and size as said frame, a method of simulating a solid wood door, said method comprising the steps of:

cutting at least one opening through both sheets of wood;

forming said at least one artificial panel from sheet portions removed from said opening into which said artificial panel is to be inserted by mounting said sheet portions on wood, said at least one artificial panel being of a different thickness than said hollow core door;

attaching each of said at least one artificial panels within each of said at least one openings.

* * * * *